US006832758B2

(12) United States Patent
Richter et al.

(10) Patent No.: US 6,832,758 B2
(45) Date of Patent: Dec. 21, 2004

(54) MOBILE FEEDER SYSTEM

(75) Inventors: Lutz Richter, Schkeuditz (DE); Frank Sommerer, Liebertwolkwitz (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/858,423

(22) Filed: May 16, 2001

(65) Prior Publication Data

US 2002/0043753 A1 Apr. 18, 2002

(30) Foreign Application Priority Data

May 16, 2000 (DE) ..... 100 23 681

(51) Int. Cl.[7] ..... B65H 9/00
(52) U.S. Cl. ..... 271/8.1; 271/9.08; 271/164
(58) Field of Search ..... 271/162, 163, 271/164, 287, 288, 289, 290, 298, 8.1, 9.08

(56) References Cited

U.S. PATENT DOCUMENTS

| | | | | |
|---|---|---|---|---|
| 3,809,385 A | * | 5/1974 | Rana | 270/52.29 |
| 5,203,549 A | | 4/1993 | Bryson, Sr. et al. | |
| 5,284,335 A | * | 2/1994 | Golicz | 271/149 |
| 5,516,090 A | | 5/1996 | Chang | |
| 5,732,941 A | * | 3/1998 | Moll | 271/10.07 |
| 5,749,568 A | * | 5/1998 | Reist | 271/9.01 |
| 6,279,891 B1 | | 8/2001 | Jaeger | |

FOREIGN PATENT DOCUMENTS

| | | |
|---|---|---|
| DE | 2 016 425 | 10/1971 |
| DE | 19616047 A1 | 10/1997 |
| DE | 19750110 A1 | 5/1999 |
| DE | 19752015 A1 | 5/1999 |
| EP | 0 917 965 A1 | 5/1999 |
| WO | WO 98/37003 | 8/1998 |

* cited by examiner

*Primary Examiner*—Dean J. Kramer
*Assistant Examiner*—Michael Lowe
(74) *Attorney, Agent, or Firm*—Laurence A. Greenberg; Werner H. Stemer; Ralph E. Locher

(57) ABSTRACT

A mobile feeder is presented for separating flat products, in particular folded sheets, flat sheets, cards, inserts and the like, for printed-product processing machines, such as in particular gatherer stitchers, collating machines or inserting machines. The feeder can be positioned variously, as required, in terms of its position in relation to a transport device.

10 Claims, 3 Drawing Sheets

MOBILE FEEDER SYSTEM

BACKGROUND OF THE INVENTION

Field of the Invention

A mobile feeder for separating flat products is described. The invention relates to a feeder for separating flat products, in particular for feeding folded sheets, flat sheets, cards, inserts and the like to printed-product processing machines, such as in particular gatherer stitchers, collating machines or inserting machines.

In order to produce printed products, such as brochures, books or magazines, it is necessary to collate a number of folded or flat sheets or cards or similar printed material, in order that they can be processed in a stapling machine or an adhesive bonder to form an end product. In addition, inserts, such as brochures, CDs, or similar printed or unprinted material are often introduced into open printed products in inserting machines or inserters, as they are known. In order to implement this technological sequence, feeders are disposed above a transport device, for example the gathering chain as it is known. Depending on the material to be processed, this is a feeder for processing horizontal or vertical stacks. In this connection, printed-product processing machines are understood to be machines for working on and/or processing printed products, such as gatherer stitchers, collating machines, inserting machines, adhesive binders or the like.

Published, Non-Prosecuted German Patent Application DE 197 52 015 A1 discloses, for example, a gatherer stitcher for producing printed products, such as periodicals, brochures, books or magazines. The gatherer stitcher has a row of feeders disposed one after another, and a transport device and a station for stapling and cutting the product. The typical machine configuration in this case has feeders permanently connected in series. The necessary feeders are fixed to a machine frame and permanently connected to the stapling machine. Depending on the embodiment, all the components can be moved both by a common shaft from a common drive source and by individual drives.

However, the known construction of feeders of this type for producing brochures, books or magazines or inserting machines, that is to say printed-product processing machines, has a significant deficiency. The position, that is to say the order of the feeders, is fixed and can be changed mechanically only by considerable effort. The feeder superstructure must be placed at this position by lifting machinery and must be connected there to the feeder subframe both mechanically, pneumatically and electrically. If a feeder is not used to produce a specific product, it has to be switched off and remains unused on the machine. The order of the feeders disposed one after another, that is to say their topology, is fixed. Changing the machine equipment, by feeders being moved to specific positions, cannot generally be implemented without technical aids, such as lifting machinery, and only with some expenditure of time.

SUMMARY OF THE INVENTION

It is accordingly an object of the invention to provide a mobile feeder system that overcomes the above-mentioned disadvantages of the prior art devices of this general type. The invention is based on the object of proposing a feeder for separating flat products, in particular folded sheets, flat sheets, cards and the like, for printed-product processing machines, such as in particular gatherer stitchers, collating machines or inserting machines, which permits flexible configuration of a system for producing printed products. In particular, the object is to propose a feeder with which it is possible to configure an apparatus for gathering printed products or for inserting inserts into printed products for producing periodicals, brochures, books or magazines in a flexible way.

With the foregoing and other objects in view there is provided, in accordance with the invention, a feeder for separating and feeding flat products, including feeding folded sheets, flat sheets, and cards, to printed-product processing machines, including gatherer stitchers, collating machines and inserting machines. The feeder contains a feeder superstructure, and an apparatus attached to the feeder superstructure for ensuring mobility of the feeder superstructure.

According to the invention, therefore, the feeder is provided with an apparatus that permits its mobility. The static connection between the feeder and the transport device of the machine is cancelled. For this purpose, the feeders are constructed in a modular and mobile fashion. They have similar connection dimensions and installation space dimensions. In other words, all the feeders are each mounted on an identical subframe as a supporting device and are configured separately from the rest of the machine. The two parts together form a module, so that they can be moved independently of the transport device and therefore, for example, with the aid of a lifting trolley. The subframes are advantageously configured to be mobile by a suitable apparatus. In a preferred embodiment, the feeder modules are equipped with wheels or rollers. The wheels or rollers can be fixed in the installed case or when desired. The modular construction makes it possible to determine the position of the feeders freely in relation to the transport device. Because of the mobility of the feeders, it is possible to change their position. Likewise, the topology of the order of the feeders can be changed.

In an advantageous development, the subframes have stops, so that positioning the feeders in relation to the transport device of the machine without difficulty is made easier. It is advantageous for the drive to the individual feeders in each case to be configured as an individual drive, so that only an electronic connection has to be produced for the purpose of interchanging data and/or control signals between the machine subassemblies of the feeders and the remaining subassemblies.

The transport device, in particular the gathering chain subframe on a gatherer stitcher, is advantageously prepared by appropriate stop devices for fixing the feeders.

The invention makes it possible to provide a system for collating printed products with feeders, which can be of different types, and a transport device. The system, provided for example on a gatherer stitcher, a collating machine or the like, is in principle independent, since it is configured separately from the rest of the machine. The system and the rest of the machine together form the gatherer stitcher, the collating machine, the inserting machine or the like. As a result of the flexible configuration of the feeder area of a gatherer stitcher, a collating machine or an inserting machine, an appropriate topology for the feeders can be selected, depending on the production job. It is therefore possible to fall in individually with customer requests.

With feeders of this type, or with a system of mobile feeders, it is possible for the printed-product processing machine to be changed over in a short time and without particular specialist knowledge. There is now the possibility of interchanging various types of feeders for folded sheets, flat sheets, cards or the like. It is likewise possible to bring up and to position the feeders from both sides to the axis defined by the transport device. Depending on the requirement, a feeder area of various types of feeders and with a variable number of feeders, which are positioned from the right and from the left with respect to the transport device, can be put together. Feeders can now also be used for different and various types of installations or machines, by being interchanged simply between the installations. In the event of maintenance and service requirements, the respective feeder can be replaced simply and quickly. Maintenance, repair or a test run can be carried out without any connection to the entire installation.

The use of mobile feeders is to be viewed as particularly advantageous on a gatherer stitcher that is provided with mutually synchronized individual drives, at least for a number of the individual movements to be implemented.

In accordance with an added feature of the invention, the apparatus has wheels and/or rollers.

In accordance with an additional feature of the invention, the apparatus which ensures the mobility can fix the feeder superstructure in place.

In accordance with another feature of the invention, the superstructure and the apparatus form a modular unit.

In accordance with a further feature of the invention, the feeder superstructure has a separating apparatus, and the apparatus that ensures the mobility has a subframe attached to the superstructure.

In accordance with a further added feature of the invention, the subframe has guides and stops.

There is provided, in accordance with the invention, a transport device for printed products. The transport device contains a frame, and stops disposed on the frame for fixing mobile feeders.

There is further provided, in accordance with the invention, a system for collating printed products, including folded sheets, flat sheets, and cards. The system contains feeders, a transport device for gathering the printed products, and a supporting device supporting a least one of the feeders. The supporting device supporting and the feeder superstructure forms a module being independent of the transport device.

In accordance with an added feature of the invention, the supporting device is able to connect to the transport device.

In accordance with an additional feature of the invention, the module has an apparatus which ensures the mobility of the at least one of the feeders.

There is additionally provided, in accordance with the invention, a gatherer stitcher containing a feeder including a feeder superstructure, and an apparatus attached to the feeder superstructure for ensuring mobility of the feeder superstructure. Instead of the gatherer stitcher, a collating machine or an inserting machine could be combined with the feeder.

There is provided, in accordance with the invention, a gatherer stitcher including a transport device for transporting printed products, containing a frame and stops disposed on the frame for fixing mobile feeders. Instead of the gatherer stitcher, a collating machine or an inserting machine could be combined with the transport devive.

Other features which are considered as characteristic for the invention are set forth in the appended claims.

Although the invention is illustrated and described herein as embodied in a mobile feeder system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
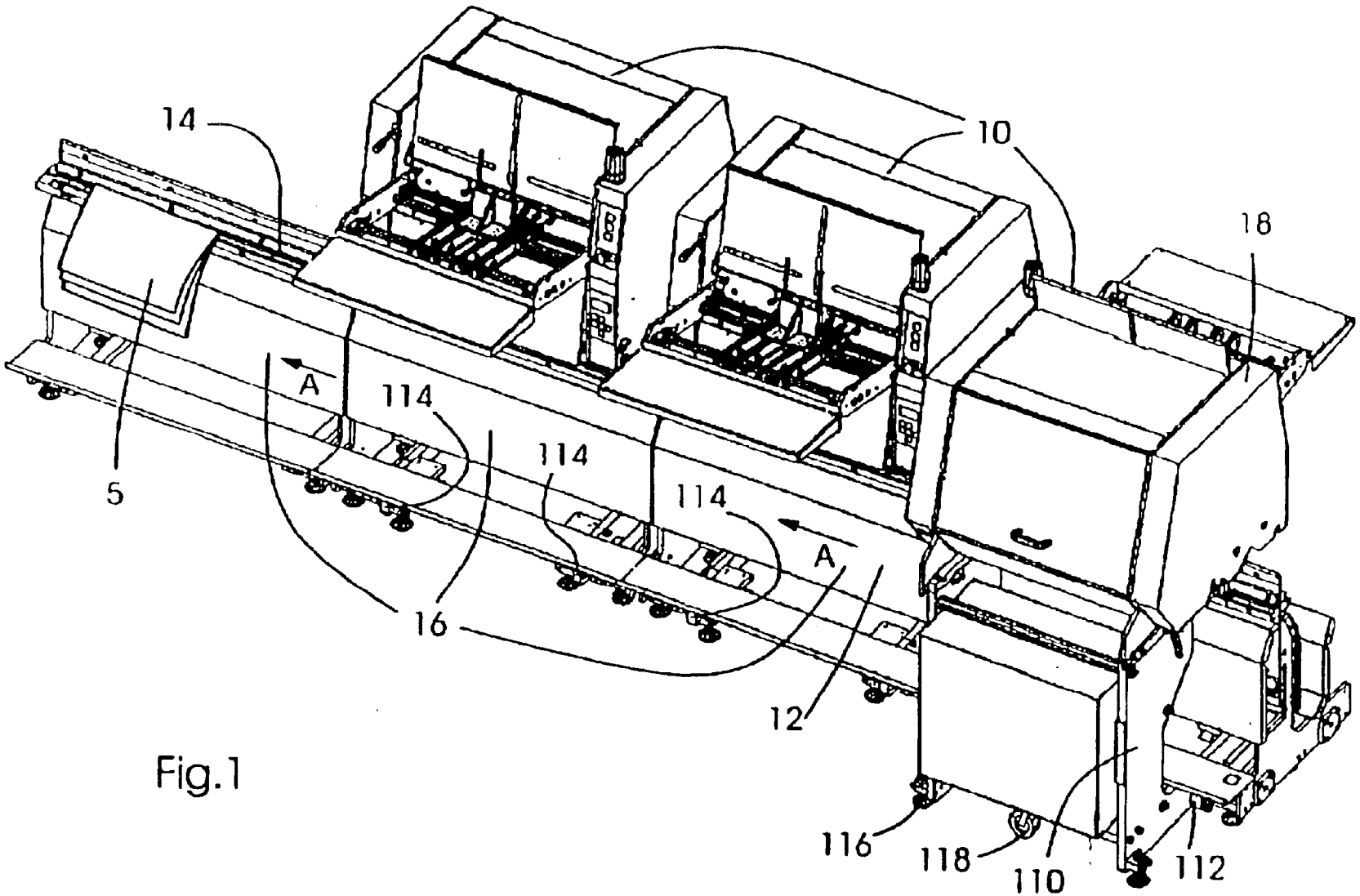
FIG. 1 is a diagrammatic, perspective view of a feeder area of a gatherer stitcher with mobile feeders according to the invention.

In all the figures of the drawing, sub-features and integral parts that correspond to one another bear the same reference symbol in each case. Referring now to the figures of the drawing in detail and first, particularly, to FIG. 1 thereof, there is shown an exemplary embodiment of a feeder 10 according to the invention and of a transport device 12 according to the invention on a gatherer stitcher and, respectively, on a collating machine. Corresponding feeders of this type can likewise be used on an inserting machine.

FIG. 1 shows the feeder area of the gatherer stitcher or of the collating machine. This is a mobile feeder. For example, shown here is a system of three feeders 10 over the transport device 12. Arrows A indicate a transport direction of flat products 5. Shown here as a specific topology is the exemplary configuration in which two of the feeders 10 are positioned from the right, and one feeder 10 is positioned from the left, with respect to an axis defined by the transport device 12. In principle the feeders 10 can be brought up to the transport device 12 in various configurations from both sides, that is to say also for example all from one side. The transport device 12 has a gathering chain 14, which is borne by transport chain frames 16. In principle, the position of the feeders 10 in relation to the transport chain can be chosen freely. However, it is advantageous during operation to fix the apparatus that ensures mobility of the feeders 10 and to fix the position of the latter. The feeders 10 each have a feeder superstructure 18 and a subframe 110, which is brought up to the gathering chain 14 in such a way that the subframe 110 is located partly under the gathering chain 14. In an advantageous development of the invention, as shown here in FIG. 1, stops 112 are provided on the subframe 110, so that positioning the feeders 10 in relation to the transport device 12 simply and without difficulty is made easier. Stops 114 are advantageously likewise provided on the transport chain frame 16. During operation, wheels 118 of the feeders 10 can be fixed by fixing screws 116. In other words, the feeders 10 have a simple mechanism to ensure their mobility, but can be rendered immobile for operation.

Figure 2:
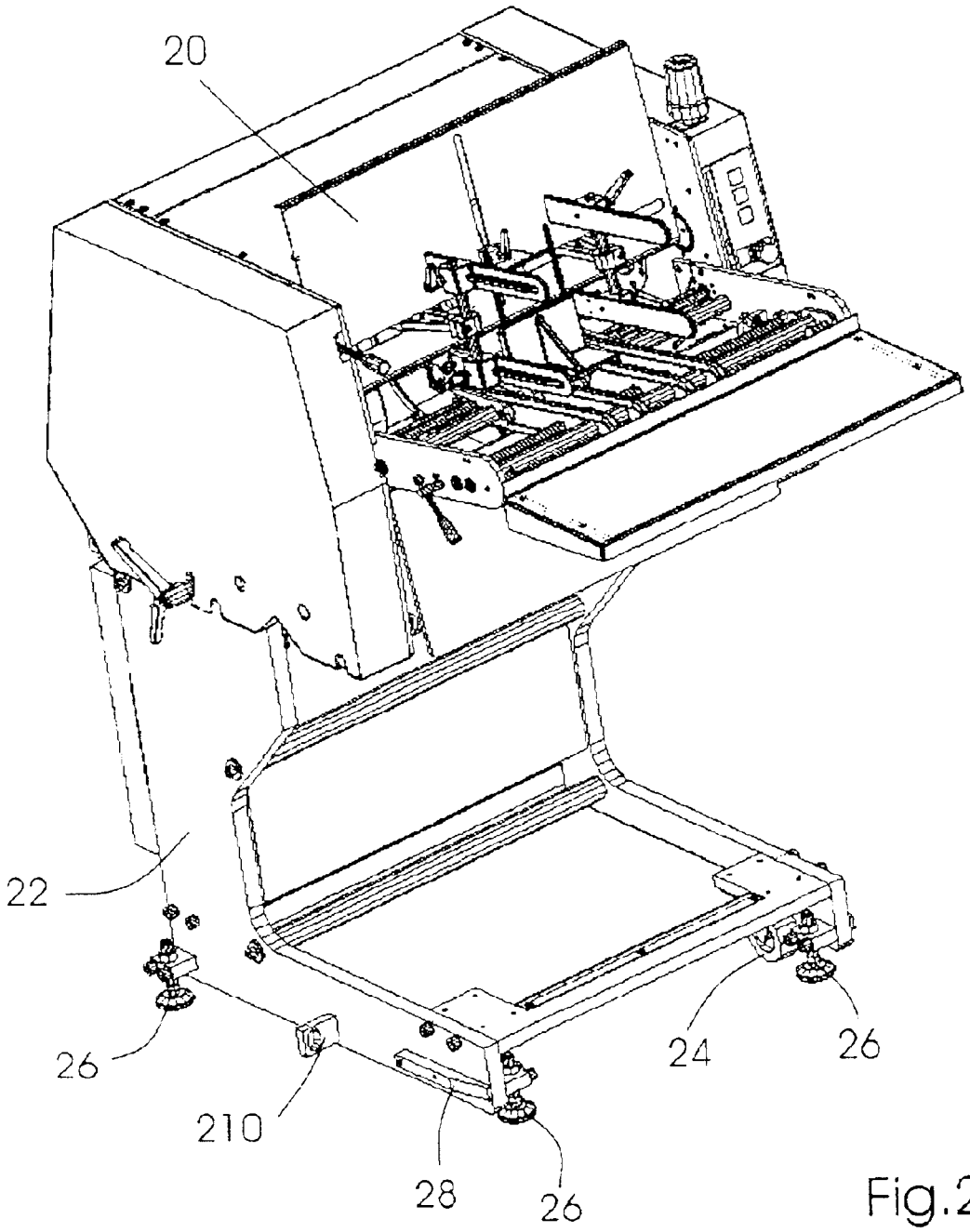
FIG. 2 is a perspective view of a mobile folded-sheet feeder on a subframe.

FIG. 2 illustrates a folded-sheet feeder. A feeder superstructure 20 is fixed to a subframe 22 as a supporting device, so that the two parts form a module. These parts of the mobile feeder are configured to be separable. The subframe 22 has wheels 24 and can be fixed by setting screws 26, so that the mobility of the feeder is ensured but the latter can be fixed during operation. By use of a guide 28 and a stop

210, positioning the feeder in relation to the transport device is simply and quickly possible.

Figure 3:
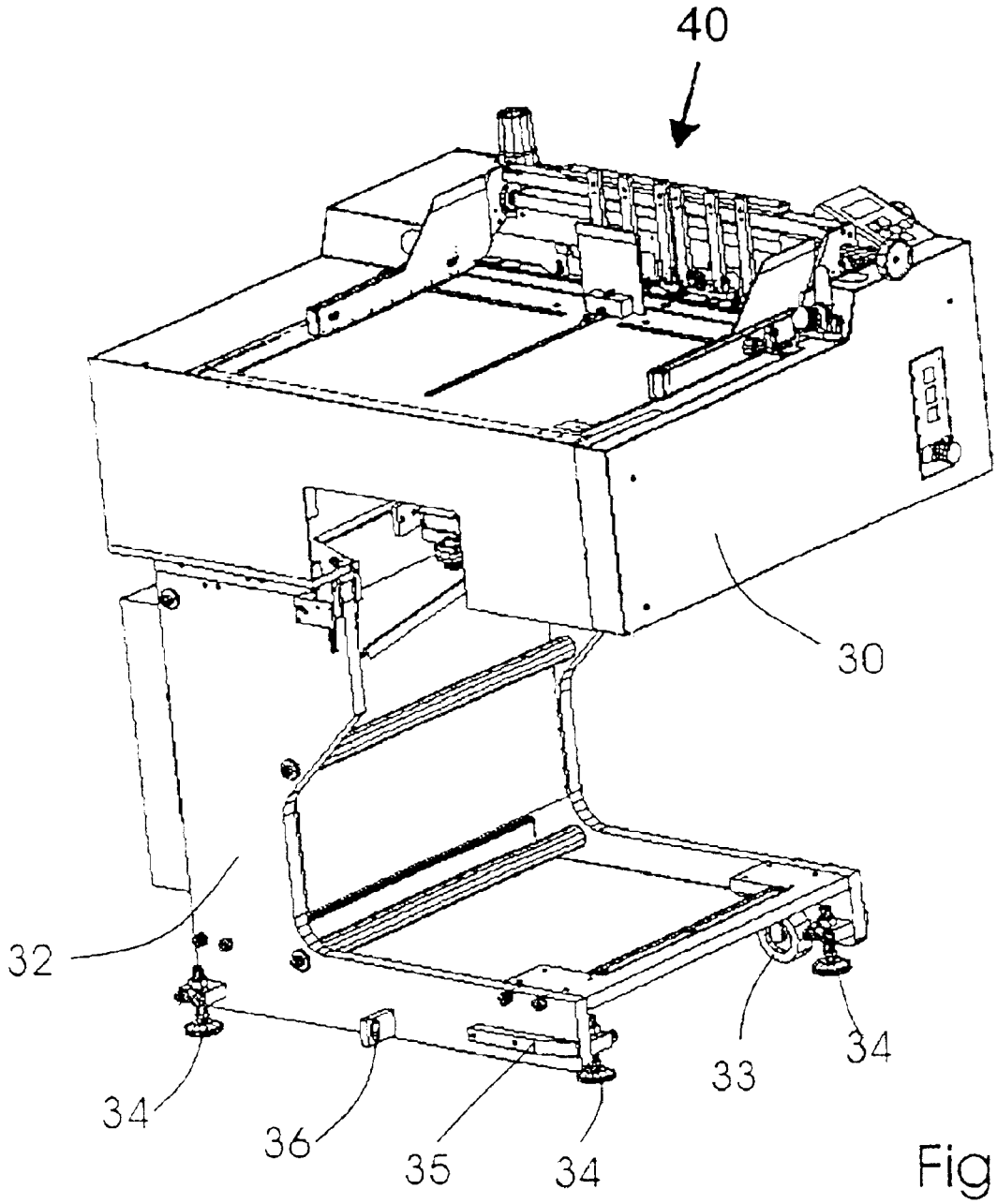
FIG. 3 is a perspective view of a mobile cover folding feeder on the subframe.

FIG. 3 shows a cover folding feeder such as can be used for flat sheets, for example. A feeder superstructure 30 rests on a subframe 32 as a supporting device, the two parts of the mobile feeder forming a module and being separable from each other. The subframe 32 can be moved with the aid of wheels 33. Setting screws 34 are used to fix it in position along an axis of the transport device 12 during operation. For precise positioning, guides 35 and stops 36 are provided. The feeder superstructure 30 has a separating apparatus 40 for separating the flat sheets.

The feeder area of the gatherer stitcher or the collating machine can also be configured individually in terms of its topology, depending on the production job, at the same time having the feeders as shown in FIGS. 2 and 3. In a corresponding way, an inserting machine can be configured to be variable, depending on the production job.

We claim:

1. A processing device for flat products, comprising:

at least one feeder;

transport chain frames;

a gathering chain borne by said transport chain frames;

said gathering chain being operatively charged with the flat products by said feeder and transporting the flat products in a transport direction;

said at least one feeder to be laterally detachably attached to said transport chain frames in a working position.

2. The processing device according to claim 1, wherein said feeder is mobile.

3. The processing device according to claim 1, wherein feeder includes fixing means for arresting said feeder at least in said working position.

4. The processing device according to claim 1, wherein said feeder forms a modular unit including a superstructure and a subframe carrying said superstructure.

5. The processing device according to claim 4, wherein said superstructure has a separating apparatus, and said subframe is equipped with one of rollers and wheels disposed to render said feeder mobile.

6. The processing device according to claim 4, wherein said subframe has guides and stops for positioning said feeder in said working position.

7. The processing device according to claim 1, wherein said transport chain frames have stops for positioning said feeder in said working position.

8. A collating device for flat printed products, comprising:

feeders disposed at respective working positions;

transport chain frames;

a gathering chain borne by said transport chain frames;

said gathering chain being operatively charged with the flat printed products by said feeders;

at least one of said feeders to be laterally detachably attached to said transport chain frames.

9. The collating device for printed products according to claim 8, wherein said at least one of said feeders is mobile.

10. The collating device according to claim 8, wherein said transport chain frames have stops for positioning said at least one of said feeders in a respective one of said working positions.

* * * * *